United States Patent [19]

Cadwell

[11] Patent Number: 4,510,780

[45] Date of Patent: Apr. 16, 1985

[54] ROTATING PUNCH DIE SYSTEM

[75] Inventor: Gilbert C. Cadwell, San Diego County, Calif.

[73] Assignee: Rohr Industries, Inc., Chula Vista, Calif.

[21] Appl. No.: 494,870

[22] Filed: May 16, 1983

[51] Int. Cl.[3] ..... B21D 39/08

[52] U.S. Cl. ..... 72/57; 72/63; 72/387

[58] Field of Search ..... 72/56, 57, 63, 465, 72/387, 319-321, 379, 388, 409, 410; 29/421 R

[56] References Cited

U.S. PATENT DOCUMENTS

| | | | |
|---|---|---|---|
| 2,783,727 | 3/1957 | Hoffmann | 72/57 |
| 2,783,728 | 3/1957 | Hoffmann | 72/57 |
| 2,859,719 | 11/1958 | Kraybill | 72/57 |
| 3,258,948 | 7/1966 | Carlson, Sr. | 72/57 |
| 3,267,713 | 8/1966 | Johnson et al. | 72/319 |
| 3,400,568 | 9/1968 | Brander | 72/387 |
| 3,913,370 | 10/1975 | Break | 72/319 |

*Primary Examiner*—Daniel C. Crane
*Assistant Examiner*—David B. Jones
*Attorney, Agent, or Firm*—Patrick J. Schlesinger; Frank D. Gilliam; Jay M. Cantor

[57] ABSTRACT

A rotating die system for cold forming of sheet metal wherein a male die rotates relative to both an hydraulically supported resilient diaphragm backing the sheet metal blank and the driving force on the male die. The male die is pivotly connected to both a draw ring and the transmitted driving force. A sheet of metal to be formed is held in place on the upper surface of a draw ring die over a forming aperture. The male die is caused to rotate within the aperture against the sheet metal to accomplish the desired forming.

6 Claims, 9 Drawing Figures

ROTATING PUNCH DIE SYSTEM

BACKGROUND OF THE INVENTION

This invention relates to improvements in the forming of ductile sheet metals into bodies of irregular shapes. It is primarily applicable to forming those materials which have a high ductility and also a low flow stress, although it may be applied also to normal materials which can be rendered sufficiently easy to stretch at elevated temperatures.

U.S. Pat. No. 837,297 teaches a method of producing shell or trough shaped cases or articles of sheet metal by first bending a sheet of metal without drawing or stretching the same and thereafter subjecting the sheet to a drawing or stretching action until the sheet of metal is brought into the shape of the desired article. This method is carried out by a male die forcing the sheet of metal into a female die cavity.

U.S. Pat. Nos. 2,783,727 and 2,783,728 teach sheet metal forming by use of male and female dies having a cushion positioned between the female die and sheet of metal. A standard hydraulic press is used to drive the male die member against the sheet of metal and the cushion.

U.S. Pat. No. 4,045,986 teaches the shaping of a ductile metal sheet by the application of pressure differentials, the peripherally clamped sheet is first urged in one direction by differential pressure against a female molding surface to form a partially shaped bubble like preform and then a male mold is advanced towards the sheet from the opposite side and a reverse pressure differential is applied to cause the preform to conform to the shape of the mold.

The simple process of hydroforming (or otherwise forming by differential pressure) into a female mold is adequate for smoothly rounded shapes that are not too deep, but tends to result in products having appreciable variations in thickness. Forming onto a male mold, either by hydroforming or other differential pressure techniques, or by advancing a male mold member into a peripherally clamped flat sheet or bubble, is also unacceptable because the part blank tends to wrinkle before any forming action can occur.

There has not been an entirely satisfactory tooling system or method of forming an initially flat, peripherally clamped, sheet of ductile sheet metal which will allow the production of relatively deep and complex shapes, while keeping to a minimum the faults hereinbefore mentioned until the emergence of the instant invention.

SUMMARY OF THE INVENTION

The instant invention provides a novel set of dies and their method of use for forming flat material into complex shaped and particularly into asymmetrical shapes.

The die set comprises a draw ring or female member having a forming aperture for the passing therethrough of a male die forming member. The male die member is pivotly connected at one surface to the female die member and to a vertical linear driving or impacting force means on the male member. The two separate pivotal connections between the female die member and the impacting force means allows the male die member to move relative thereto and pivot into the sheet metal to be formed, thereby forming asymmetrical shapes.

An object of this invention is to form flat sheet metal into asymmetrical shapes while overcoming the inadequacies of the prior art.

A further object of this invention is to provide lower cost asymmetrical articles.

A still further object of this invention is to provide asymmetrically formed articles with a minimum of material scrap.

These and other objects and advantages of the invention will become better understood by reference to the following detailed description, when considered with the drawings, in which:

DETAILED DESCRIPTION OF THE INVENTION

Figure 1:
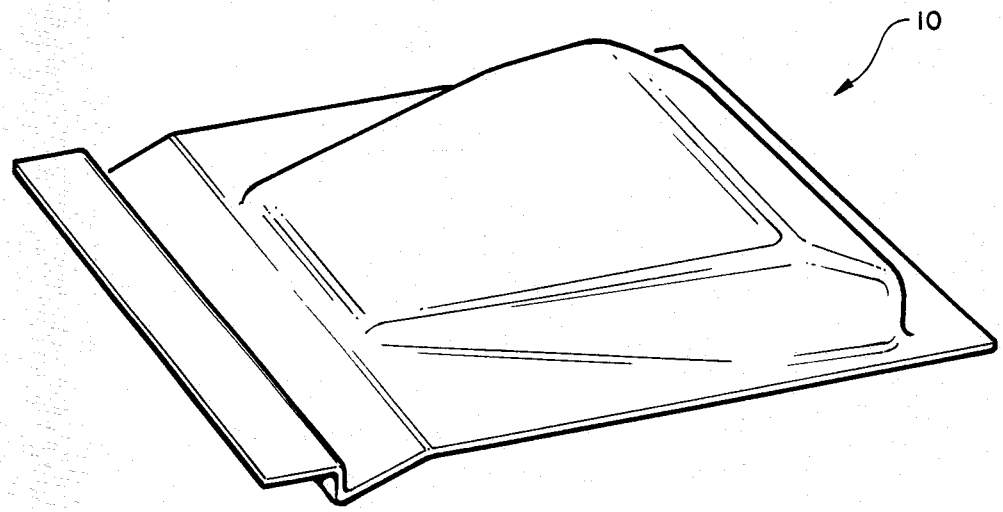
FIG. 1 is a perspective of a typical article as formed by the rotating punch die of the invention.

An example of an asymmetrical shape article 10 formed by the die system of the invention is shown in FIG. 1. The article 10 is shown after it has been formed from a suitable sheet metal blank and prior to having excess material trimmed therefrom to produce the article 10 in its final configuration. It should be understood that articles of different asymmetrical shapes can be formed by use of differently configured male and female die shapes following the inventive concepts of this invention. The particular shape shown was chosen for ease of explanation.

Figure 2:
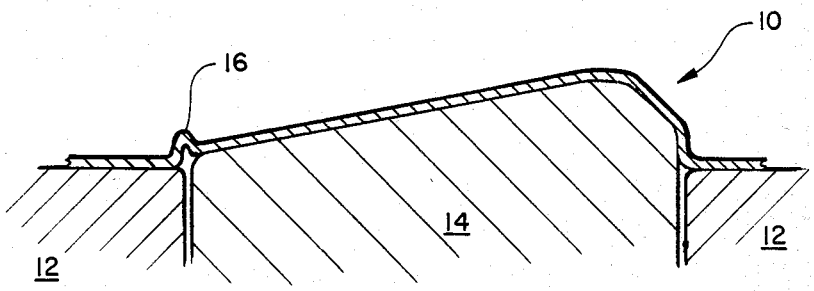
PRIOR ART FIGURE 2
FIG. 2 depicts a diagramatic showing of prior art die used to form an article of the FIG. 1 configuration over a male die system.

FIG. 2 is a diagrammatic showing of a prior art method of forming article 10, as shown in FIG. 1, by forcing the male die member 14 upwardly through an aperture in the female die member 12 against the metal sheet 11. The female die member 12, a male die member or punch 14 and a partially formed article 10 are shown. As indicated by the numeral 16, an excess of material will tend to occur during forming, resulting in a wrinkle that must be trimmed from the article 10 if possible or if not the part 10 is scrapped as unacceptable.

Figure 3:
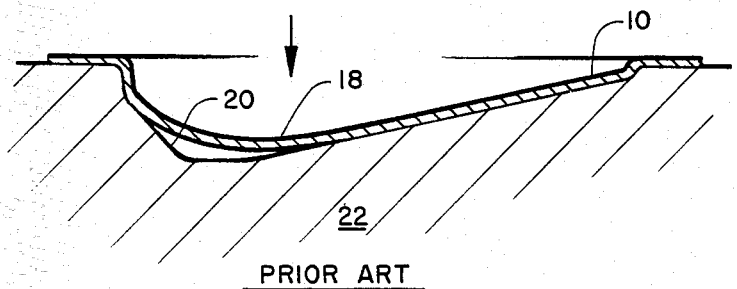
PRIOR ART FIGURE 3
FIG. 3 depicts a diagramatic showing of a prior art female blowdown die used to form an article of the FIG. 1 configuration.

FIG. 3 is a diagrammatic showing of a second prior art method of forming an article 10 configuration as shown in FIG. 1. A sheet of material 19 is blown down into the cavity 20 of the female mold 22. This method often results in excessive thinning and/or rupture of the metal sheet 19, particularly in the general area of location 18.

Figure 4:
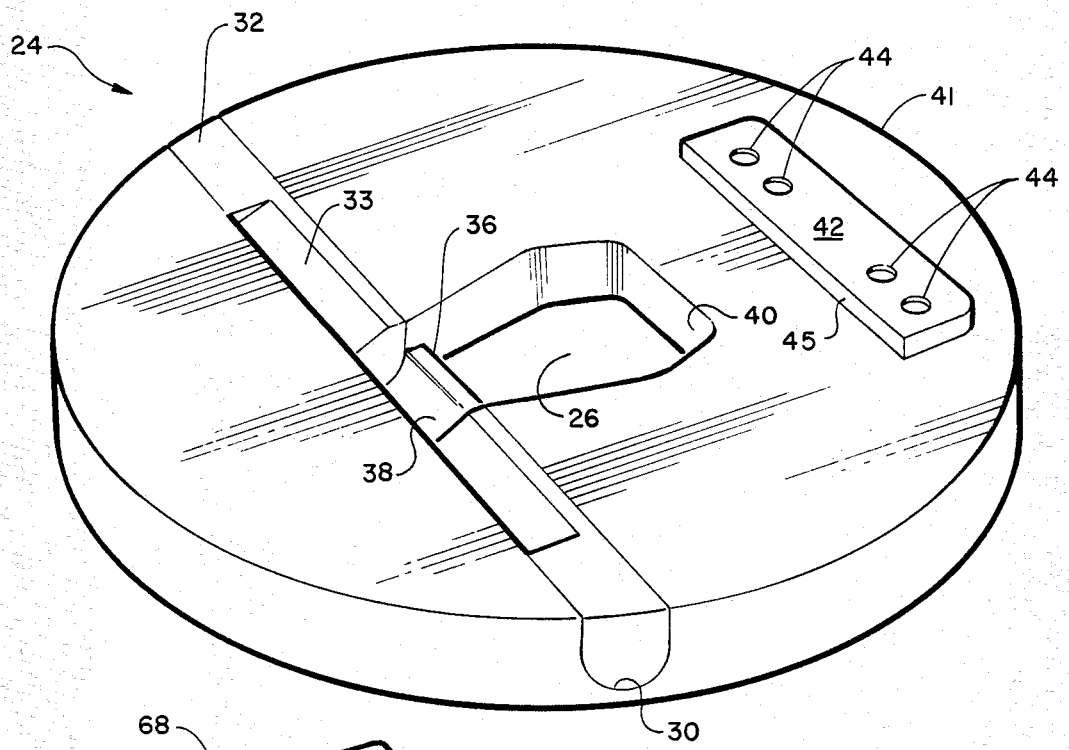
FIG. 4 is a perspective showing of the female die member of the invention.

Referring now to FIG. 4, the draw ring or female die member 24 of the invention is shown. The female die member 24 includes an aperture 26 centrally located through the die 24 and configured to an approximate plan shape of the article to be formed. The female die member 24 is provided with an elongated curvilinear slot 30 in which is positioned a filler bar 32 on either side of the aperture 26. Each filler bar 32 is provided with a recessed portion 33 on its upper surface for forming the article 10 into its desired configuration. Thus, the bars 32 should be considered as forming an integral portion of the female die member 24. It should be understood, however, that differently configured articles 10 may not require the provision of recesses 33 in the filler bars 32. The slot 30 is separated from the aperture 26 by a wall member 36, the purpose of which will be hereinafter explained. Between the opposite end surface 40 of the aperture 26 and the outer surface 41 of the female die member 24 is a suitable alignment pedestal 42. The upper surface of the pedestal 42 contains a plurality of apertures 44 which mate with pins (not shown) on one surface of the draw ring or female die member 24. Thus, the alignment pedestal 42 is removably positioned on die 24 and the shear load is taken by the pedestal 42 during the sizing of certain corner radius. The use of alignment apertures and mating pins is well known in the tooling art and therefore, need not be explained in detail.

Figure 6:
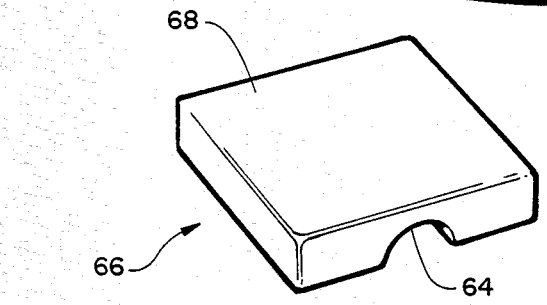
FIG. 6 is a perspective showing of a tool for aiding in the forming process; and FIGS. *7a, 7b,* and *7c* show a side view of the assembled tool and the sequence of operations of the male die member of the invention when forming the article of FIG. 1.
Figure 6:
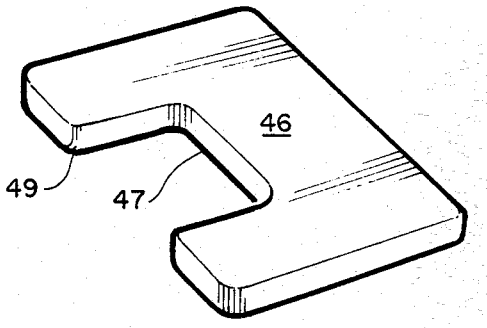

A coin ring 46 may be advantageously used in the practice of the present invention. The forming tool 46, see FIGS. 6 and 7*a*, generally "C" shaped in plan view, is provided with an opening 47 which conforms to the shape of the adjacent portion of the aperture 26 so that in the forming of the article 10 the walls of the opening 47 act as a continuation of a portion of the forming die system. The forming tool 46 butts against surface 45 of pedestal 42 for longitudinal alignment of the tool 46 thereby extending the end walls of aperture 26 for the purpose of controlling the radius on the part 10 at this point. As seen most clearly in FIG. 7*c*, the wall of the opening 47 that is positioned adjacent to the die 28 is provided with an arcuate shoulder 49 to aid in controlling the radius of the wall of part 10 as previously set forth.

Figure 5:
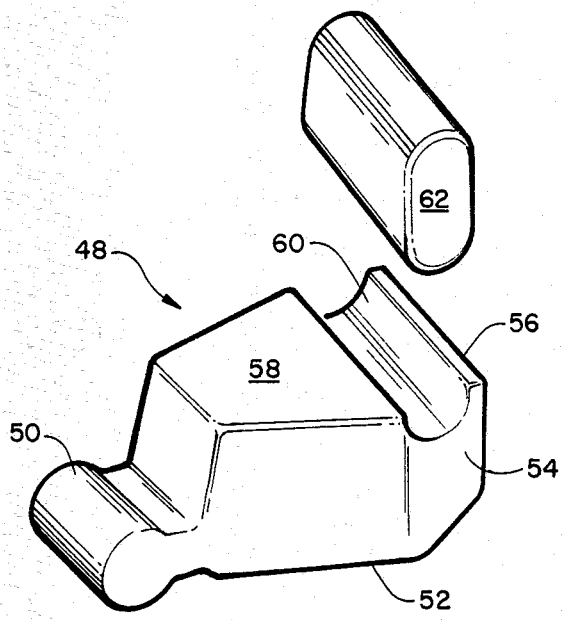
FIG. 5 is an inverted perspective showing of the male die member and impact means linkage of the invention.

Referring now to FIG. 5, the male die member 48 shown inverted for ease of illustration includes a cylindrical tip 50 which is configured to engage the curvilinear groove 30 of the draw ring or female die member 24. The cylindrical tip 50 of the male die member allows the male die member 48 to pivot within the aperture 26 of the female die member 24. The adjacent surface 52, vertical sides 54 and end surface 56 have the desired shape of the internal configuration of the finished article 10. These forming surfaces may have a sand blasted finish. The bottom surface 58 of the male die member 48 includes a curvilinear portion 60 for receiving a bearing or link pivot pin 62. The bearing or link pin 62 likewise is received in the curvilinear groove 64 of the strike member 66.

Figure 7A:
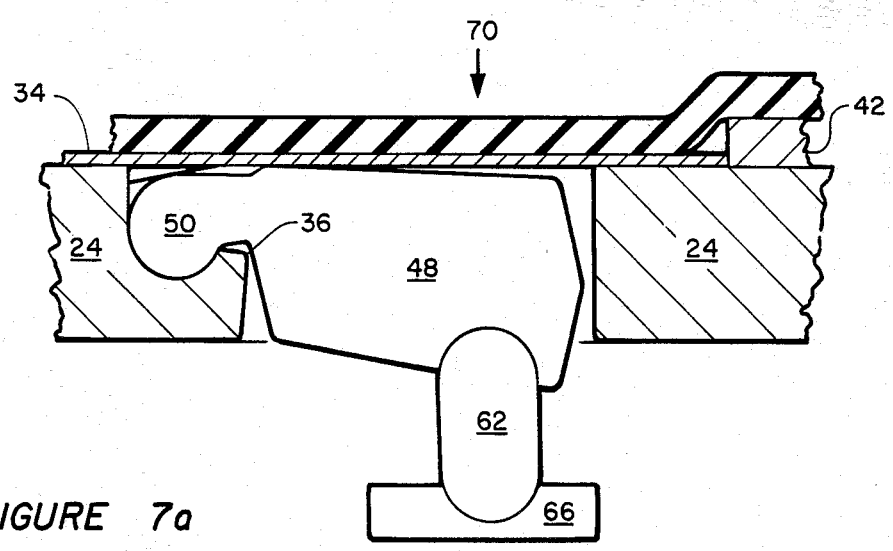
Figure 7B:
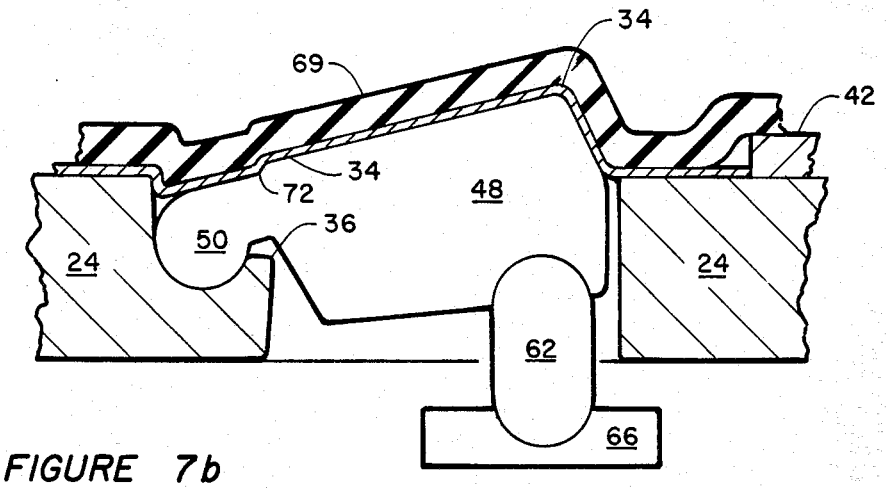
Figure 7C:
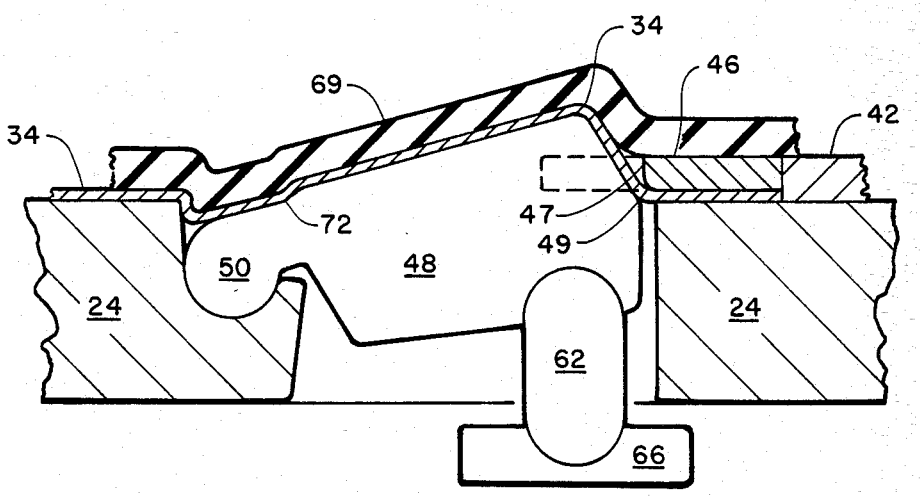

It should be understood that the strike force is a vertical linear force provided by a suitable press and directed against the flat surface 68 of the strike member 66. This strike force which may be a portion of a hydroforming press (not shown) translates the strike member 66 in a vertical linear direction as seen in FIGS. 7*a*, 7*b*, and 7*c*. The bearing or driving link pin 62 causes the male die member 48 to rotate relative to the direction of movement of the strike force against member 66.

It should be further understood that all of the elements of the rotating punch die system must be constructed of a suitable material to function as herein described.

Referring now to FIGS. 7*a*, 7*b*, and 7*c*, these Figs. show the sequence of forming steps utilized to produce the article 10 from a sheet of material 34 by this invention.

FIG. 7*a* is a diagramatic showing of the placement location of the various components of the forming system including the female die member 24, male die member, pedestal 42, the sheet material 34 to be formed, the link 62 and strike member 66. The material 34 is shown in position for forming prior to any force being applied to the strike member 66. In the hydroforming application of the present invention a suitable resilient diaphram 69 backed by the requisite hydraulic pressure, as indicated by reference character 70, urges the sheet metal 34 toward the rotating punch die system of the instant invention and secures it against lateral movement.

FIG. 7*b* is a diagramatic showing of the die forming system as described above with the sheet of metal in a partially formed article 10 configuration. A vertical linear force is now being applied to the strike member 66 along arrow 70 causing the male die member 48 to rotate about its connection 50 with the female die member cylindrical indentation 30. It will be seen that as the strike member 66 is urged upwardly the drive link 62 rotates slightly within the receiving curved apertures 60 and 64 to maintain a vertical driving force on the male die 48 to cause it to rotate within the aperture 30 that receives the lip 50 of said die 48. It will be seen than the hydraulic pressure 70 has compressed the resilient blanket 69.

FIG. 7*c* is a diagramatic showing of the location of the male die member 48 relative to the female die member 24 when the article 10 is formed in approximately its final configuration from metal sheet 34. In the event the radius of the formed walls of the part 10 cannot be formed from the impression of the male die member 48, an initial forming of the part 10 is made and then the hydroforming press is caused to raise the hydraulically pressured blanket 69. The coin ring 46 is then positioned around the part 10 with the alignment shoulder 42 laterally aligning the coin ring 42 and the "C" shaped opening 47 closely fitting around the part 10. The blanket is then lowered and pressurized to cause the circular shoulder 49 of the coin ring 46 to form the desired radius in the wall of the part 10.

It should be noted that the travel of the male die end surface 56 is terminated short of engagement with the end surface of the aperture 26 thereby preventing contact that could jam the male and female die members 48 and 24 together causing damage to the dies. In the illustrated embodiment of the invention it will be seen that the upper surface of the male die 48 provides an upset portion to part 10, as seen generally at point 72 in FIG. 7*b*. It should be recognized that in the event the part 10 is not provided with an upset portion and instead provides for a smooth transition to the upper surface of the die 24 that size and shape of the groove 30 and the lip 50 of the die 48 will be approximately chosen so as to permit such smooth transition of the part 10.

The invention is not restricted to the illustrated embodiment but many of the described features may be modified or substituted without departing from the spirit of the invention. All modifications and adaptations of the invention are intended to be covered by the claims.

What is claimed is:

1. A die for cold forming sheet metal comprising:

a male die member having metal forming surfaces a cylindrical end surface and a striker surface opposite one of said metal forming surfaces, said striker surface includes a curvilinear indentation;

a female die member with a central aperture therethrough and a curvilinear socket adjacent thereto, said socket receiving and securing said cylinder end surface of said male die member therein; and resilient diaphragm means overlying the female die member for holding said sheet metal to be formed in position on the surface of said female die adjacent said forming surfaces of said male die member, whereby said male die member pivots about said cylindrical end surface within said aperture when impacted in the curvilinear indention on the striking surface by a driving force means thereby forming said sheet metal.

2. The invention as defined in claim 1 wherein the driving force means comprises a plate member with a flat surface having a central curvilinear indentation therein and a pin member whereby said pin member mates with both said central curvilinear indentation and cylindrical indentation thereby allowing said male die member to rotate relative to said plate member.

3. The invention as defined in claim 1 wherein said curvilinear indentation is located on the end of said striker surface on the side of said male member opposite from said cylindrical end surface.

4. The invention as defined in claim 1 wherein said die further comprises a ring member with a forming surface for positioning over at least a portion of said surface of said sheet metal for forming at least a portion of said sheet metal.

5. A method of cold forming sheet metal comprising:

securing the sheet metal to be formed over an aperture through a female die member;

placing a resilient diaphragm on said sheet metal with pressure applied thereto, said pressure directed toward said sheet metal; and applying a linear driving force to a male die member through said aperture whereby said male die member rotates within said aperture relative to said female die member and said driving force thereby forming said sheet metal to the configuration of the contacting surfaces of said male die member.

6. The method of claim 5 further including the steps of:

positioning a coin ring member having curved shoulders adjacent to the formed part; and applying a force to the ring member to cause the curved shoulders thereof to form a desired radius to the walls of the formed sheet metal.

* * * * *